United States Patent [19]

Busby

[11] 4,339,009

[45] Jul. 13, 1982

[54] BUTTON ASSEMBLY FOR ROTARY ROCK CUTTERS

[76] Inventor: Donald W. Busby, 5060 Nome St., Denver, Colo. 80239

[21] Appl. No.: 107,569

[22] Filed: Dec. 27, 1979

[30] Foreign Application Priority Data

Mar. 27, 1979 [ZA] South Africa ..... 79/1451

[51] Int. Cl.[3] ..... E21B 10/52

[52] U.S. Cl. ..... 175/374; 175/410

[58] Field of Search ..... 175/374, 410, 409; 76/108 A, 101 E; 407/117, 118

[56] References Cited

U.S. PATENT DOCUMENTS 2,121,202 6/1938 Killgore ..... 175/374
3,693,736 9/1972 Gardner ..... 175/410
3,984,910 10/1976 Helton et al. ..... 175/374

FOREIGN PATENT DOCUMENTS 205743 7/1968 U.S.S.R. ..... 175/410

*Primary Examiner*—William F. Pate, III
*Attorney, Agent, or Firm*—Robert C. Dorr

[57] ABSTRACT

A button assembly for a rotary rock cutter utilized in the penetration of rock strata, especially subterranean strata, having a highly abrasion resistant insert, such as tungsten carbide. The insert is supported by a button having a high abrasion resistance and a transverse significantly higher rupture strength than tungsten carbide. The button penetrates rock strata while continually supporting the insert. The button assembly is fixedly secured to a rotary rock cutter and may be secured in such a manner as to provide a circumferentially extending disc cutting surface.

1 Claim, 11 Drawing Figures

BUTTON ASSEMBLY FOR ROTARY ROCK CUTTERS

BACKGROUND OF THE INVENTION

1. Field of the Invention

This invention relates to tungsten carbide button assemblies utilized in rotary rock cutters, and more particularly, to such a button assembly using significantly less tungsten carbide supported in a button which has a high abrasion resistance and a significantly higher transverse rupture strength than the tungsten carbide.

2. Background of the Prior Art

Rotary cutters, especially those utilized to penetrate subterranean rock strata, were originally utilized to penetrate relatively soft rock strata. Wear resistant tips of solid tungsten carbide were conventionally utilized on the cutter head of the rotary rock cutter and were fixedly secured thereto by means of silver solder. However, as those cutters were utilized to penetrate strata of increased hardness, the heat generated during such drilling melted the silver solder thereby causing the wear resistant tips to loosen and eventually to become unsecured. In addition, the silver solder bond would fail to hold the wear resistant tips when load pressures approximating 10,000 psi were exceeded.

It became imperative to develop rotary rock cutters which could withstand the increased load pressures needed to penetrate relatively harder subterranean strata. Rotary disc cutters were then developed to penetrate subterranean strata at load pressures of up to about 35,000 psi or greater where the strata is fractured. One category of conventional rotary disc cutters has a plurality of circumferentially extending discs usually constructed of steel which cut kerfs, or grooves, into the strata, and due to the wedging action thereof within the kerfs, create fracture planes in the strata. The fracture planes thus formed allow rock between the kerfs to break into relatively large chunks which may then be removed from the bore hole. In a second category, conventional hard rock rotary cutters have been developed to penetrate subterranean strata under load pressures of over 15,000 psi. Such hard rock cutters include both the tri-cone cutter and the large diameter big hole cutter which is employed in rotary drillings, such as applications of raise boring or tunnel boring. Hard rock cutters theoretically crush or break the rock strata penetrated thereby.

Both the steel disc cutters and the hard rock cutters employ wear resistant inserts or buttons in the cutting surface to extend the useful life thereof. Conventionally, an annular ring having a cross sectional, wedge shaped configuration is employed as the cutting surface for a rotary disc cutter. This annular ring is heat shrunk onto the rotary disc cutter and is formed of a wear resistant material, such as a 4330 or 4340 high alloy steel. Such annular rings are conventionally secured against relative movement with respect to the cutter by positioning each ring between a circumferentially extending annular shoulder and a plurality of pins which are suitably positioned around the circumference of the cutter. The selection of the specific material from which the annular ring is to be constructed is critical. If the material is too hard, the annular ring will fracture at high load pressures and if the material is too soft the annular ring will not withstand impact loads to which it is subjected and will deteriorate. These impact loads also tend to degrade the shrink fit causing the annular ring to loosen on the cutter. The soft material which the annular ring is constructed of cannot be heat treated to increase the hardness thereof since the material will become too brittle and the configuration of the bores into which wear resistant inserts are press fitted will change. Moreover, 4330 and 4340 high alloy steel which is commonly utilized to construct the annular ring is not relatively highly abrasion resistant, and therefore, rapidly erodes. Furthermore, it is not practical to fixedly secure the annular ring to the rotary disc cutter by means of silver solder. The large surface area of the ring cannot be sufficiently secured by soldering to withstand load pressures approximating 10,000 psi.

It is conventional to employ tungsten carbide button assemblies in the cutting surface of hard rock cutters since tungsten carbide is highly abrasion resistant, and therefore, extends the useful life of the rotary bit. However, conventional hard rock cutters utilize a relatively large number of buttons at relatively small spacings, e.g., one inch, to prevent high load pressures on any individual button. The height at which the buttons extend above the rotary bit surface is limited to about one-half inch since transverse shearing of the carbide inserts will occur when the insert is unsupported for over half an inch at these relatively high load pressures.

The relatively small distances the carbide inserts protrude from the rotary bit creates an additional problem of matrix washing. Crushed rock and rock chips may become positioned between the carbide buttons and contact the main matrix of the rotary bit thereby washing away or abrading the matrix. Extensive matrix washing can degrade the button support to the extent that the buttons loosen and eventually become unsecured from the rotary bit. Severe washing occurs because matrix material is machineable, and therefore, relatively low in abrasion resistance.

Several prior art patents relate to rotary rock cutters and wear resistant inserts or button assemblies therefore. U.S. Pat. No. 2,121,202 (issued on June 21, 1938 to Killgore) discloses tapered hard metal inserts for both rotary disc cutters and roller cutters of cylindrical and conical form. The tapered inserts are positioned in correspondingly tapered holes or openings in the cutter matrix, and held in place by the gripping effect of the matrix metal. The inserts may or may not be bottomed in the openings. Further, the inserts and openings of Kilgore may be untapered or cylindrical and the inserts may be heat shrunk into the matrix. As utilized in a disc cutter, the inserts provide peripherally positioned teeth. These teeth may be reinforced by the placement of hard metal bodies therebetween. When extremely abrasive formations are encountered, the breaking of the cutting teeth may be minimized by employing a composite insert positioned within the insert. This composite insert is constructed of a diamond metal, such as tungsten carbide, and the insert is constructed of a hard metal, such as one of the tough and hard, high speed, or air-hardened alloys. The tapering of the inserts provide the structural strength.

U.S. Pat. No. 3,311,181 (issued on Mar. 28, 1967 to Fowler) relates to rock drill teeth positioned in sockets formed in the drill bit matrix. Each tooth is split along its longitudinal axis thereby forming a working section and a correspondingly configured holding section. The working section is formed of a material having considerably greater hardness than that of the holding section or the bit matrix, such as, inter alia, tungsten carbide.

The holding section and the bit matrix can be of any suitable material, preferably the matrix being of a somewhat softer material than the holding section. Thus, the material of the holding section erodes more rapidly than that of the working section thereby exposing effective portions of the working section for continued cutting action. The composite tooth may be cemented or heat shrunk in the sockets. Alternatively, the longitudinal split may be formed so as to provide a wedgeshaped holding section to additionally support the working section within the bit matrix.

U.S. Pat. No. 3,693,736 (issued on Sept. 26, 1972 to Gardner) discloses several configured inserts and cooperative sleeve assemblies for use in the solid and rotary type rock bits. The composite cutter insert assemblies comprise a tungsten carbide cutter element having a sleeve jacket secured therearound, such as by a press fit. The sleeve is preferably constructed of steel having a high yield point and high ductility so that the sleeve will wear away during drilling to continuously expose additional carbide until the cutter element is worn out. The sleeve may then be machined to allow replacement of the worn out carbide cutter element. The composite insert may be secured within the bit body by a press fit, by brazing or silver soldering techniques. In certain disclosed embodiments, the sleeve jacket may protrude beyond the bit body.

U.S. Pat. No. 3,749,190 (issued on July 31, 1973 to Shipman) relates to a sleeve having either a uniform wall thickness or a tapered wall which is inserted between a tapered carbide button positioned within a cylindrical bore in a rock drill bit matrix. The bore has an annular undercut near the lower end thereof. The sleeve is wedged between the carbide button and the bore wall with sufficient force to extrude part of the sleeve into the undercut so as to increase the retaining strength of the sleeve. The sleeve does not protrude from the bit body.

U.S. Pat. No. 3,771,612 (issued on Nov. 13, 1973 to Adcock) relates to replaceable wear resistant cutting elements for earth drilling, crushing and engaging equipment. The cutting elements have a wear resistant cutter insert or button surrounded (except at the forward end thereof) by a relatively tough, non-brittle hardened alloy steel sleeve which is preferably longitudinally split. Such longitudinal split allows the sleeve to be more resilient by permitting a large degree of circumferential expansion and contraction. The sleeve and cutter insert or button are mounted within a recess in the drill bit by means of an anvil stool or pedestal. This anvil stool or pedestal has a shearable means projecting radially outward from the stem thereof for supporting the sleeve during normal operation and for enabling the sleeve to be moved towards the back wall of the recess thereby releasing the wear resistant element or button for replacement. The sleeve normally projects slightly outward from the bit body.

U.S. Pat. No. 3,852,874 (issued on Dec. 10, 1974 to Pearson) discloses a method of inserting a button sleeve assembly into a slightly oversized bore in a rock drill head or the like. The bit and sleeve can be manufactured and stored as an integral unit and then adapted for installation in various size bores in rock drill heads. The sleeve extends outwardly beyond the bore thus protecting the edge of the bore from damage due to percussive loading on the button. Preferably the sleeve is made from 4340 high alloy steel and then heat treated to produce a hardness of 38 to 40 Rockwell so that it can be machined.

All of these prior art approaches share common problems in that the supporting sleeve (in the Fowler patent the holding section of the drill teeth) is not designed to penetrate or cut, and therefore, erodes away in a relatively quick manner. In fact, Pearson and Gardner are designed to be machinable or to wear away. The tungsten carbide insert or button in each prior art approach are designed to perform the cutting. Tungsten carbide which has long been utilized for its high abrasion resistance cutting qualities has a low transverse rupture strength causing fracturing and breaking. Thus, the tungsten carbide inserts or buttons are constructed to protrude only a very short distance from the bit body which, while aiding in minimizing shearing and fracturing of the insert or button, also reduces the useful cutting life thereof.

In addition, the prior art inserts or buttons are manufactured so as to have a relatively large portion of the tungsten carbide below the matrix surface and to have a large diameter with respect to the supporting sleeve in an attempt to minimize the fracturing problem and in order to hold the carbide in the matrix. As wear resistant materials, such as tungsten carbide utilized to construct inserts or buttons are relatively expensive, the cost of prior art approaches are relatively high. The cost of manufacturing rock cutters equipped with prior art insert or button assemblies is further increased by the relatively large number of inserts required to withstand high load pressures.

It can be appreciated that a need exists for abrasion resistant button assemblies for rotary rock cutters having extended useful cutting lives and reduced costs of manufacturing especially in the amount of tungsten carbide being used.

As will become apparent in the following, the button assembly of the present invention utilizes a button having high abrasion resistance and a significantly higher transverse rupture strength than the tungsten carbide which cooperates with the tungsten carbide insert to provide effective cutting at a significant cost reduction due to the small amount of tungsten carbide actually used and to provide significant longer wearing capability due to the lengthy extensive protrusion of the button of the present invention over prior approaches. Due to this extensive protrusion, compacting of rock around the button assembly is minimized and chip relief is maximized. Less energy is required to operate cutters using the button assemblies of the present invention due to the substantially increased chip relief. The increased chip relief also reduces matrix washing around the button assemblies of the present invention thereby prolonging the life of the cutter and minimizing loss of buttons due to washing. Furthermore, the button assemblies of the present invention are designed not to be replaced.

The cooperation of the button with the tungsten carbide insert results in an interaction that continually causes the tip of the carbide to impact the rock strata and the sides of the button to impact the rock while the button continually provides support to the insert to minimize transverse rupturing of the carbide. Because of this cooperation, the button assembly of the present invention is capable of providing the first practical application of tungsten carbide to rotary disc cutters.

In addition to the above prior art references, which were uncovered in a patentability search, the following references were also uncovered but were not considered to be as pertinent: Kreag, U.S. Pat. No. 2,065,898, "Tool and Method of Making Same" (Dec. 29, 1936); Killgore, U.S. Pat. No. 2,161,062, "Percussion Tool" (June 6, 1939); and Kniff, U.S. Pat. No. 3,807,804, "Impacting Tool With Tungsten Carbide Insert Tip", (Apr. 30, 1974).

SUMMARY OF THE INVENTION

The present invention relates to a button assembly for use in conjunction with rotary rock cutters. The assembly has a highly abrasion resistant tungsten carbide insert for penetrating subterranean strata and a button for both supporting the insert against transverse rupturing during penetration of subterranean strata and for penetrating the subterranean strata. The button is constructed of a material having a relative high abrasion resistance, so as to be non-machinable, and a significantly higher transverse rupture strength than the insert. The button, therefore, erodes upon penetration of said subterranean strata at a rate less but close to that of the insert.

In a preferred embodiment the button of the present invention can be utilized in a rotary disc cutter.

The button assembly of the present invention may be fixedly secured in a rotary rock cutter, such as by press fitting the button into a bore formed within the rock cutter matrix. As so secured, the button assembly protrudes a substantial distance above the external face of the rotary rock cutter.

BRIEF DESCRIPTION OF THE DRAWING

The invention will be more readily understood by reference to the accompanying drawing wherein like reference numerals indicate like elements throughout the drawing figures and in which.

DETAILED DESCRIPTION

The present invention relates to abrasion resistant button assemblies for rotary rock cutters. As utilized throughout this description, the term "rotary rock cutter" is inclusive of any rock cutter which is mounted on antifriction bearings and which does not primarily utilize percussive force for cutting purposes. Specifically included in the term "rotary rock cutter" are rotary disc cutters which are utilized to penetrate subterranean strata at load pressures of up to about 55,000 psi and hard rock rotary cutters, such as a tri-cone cutter or a large diameter big hole cutter, which are utilized to penetrate subterranean strata at load pressures of about 15,000 to about 50,000 psi.

As also utilized throughout this description, the term "machinable" material is a material which may be penetrated and removed by a rotating cutting bit which utilizes a tungsten carbide or ceramic cutting tip. In contrast, certain materials which cannot be machined must be "ground" to be removed from the matrix from which the material is secured. The material is "ground" by contact with a cemented (diamond containing) abrasion wheel.

Figure 1A:
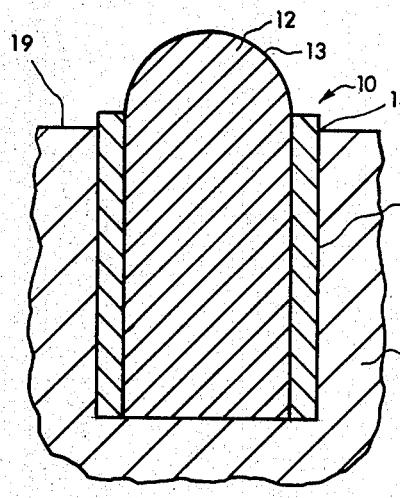
FIG. 1*a* is a cross sectional view of a prior art button assembly as secured to a rotary rock cutter.
Figure 1B:
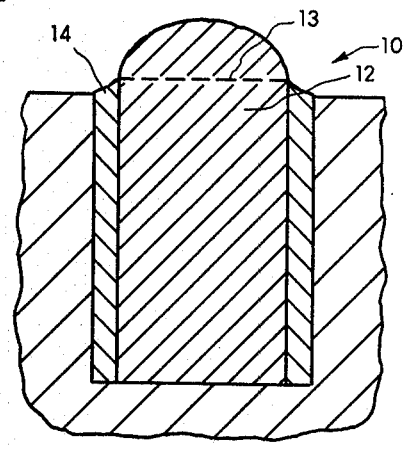
PRIOR ART Fig. 1b
FIG. 1*b* is a cross sectional view of a prior art button assembly secured to a rotary rock cutter, depicting wear due to penetration of subterranean strata.

Referring to FIG. 1, a prior art button assembly is illustrated generally at 10. Button assembly 10 has a button 12 and a sleeve 14. The button assembly 10 is fixedly secured within a bore 16 of a rotary rock cutter matrix 18. Sleeve 14 is dimensioned so as to provide an interference fit with both button 12 and bore 16 when assembled within matrix 18. As assembled, the upper edge of sleeve 14 may protrude outwardly beyond the external face 19 of rotary rock cutter matrix 18, and the cutting surface 13 of button 12 projects outwardly beyond the outer surface of the sleeve 14. Thus, as the rotary rock cutter utilizing such prior art button assemblies is rotated into contact with a subterranean strata, outwardly projecting cutting face 13 eventually contacts the subterranean strata and penetrates the strata. Upon penetrating the strata a relatively short distance, the upper portion of sleeve 14 will contact the subterranean strata. Due to the relative softness of the sleeve and the design of the sleeve, the sleeve will not assist the carbide in breaking the strata. As illustrated in FIG. 1*b*, penetration of a subterranean strata will cause uneven wear between sleeve 14 and button 12.

Conventionally, button 12 is formed of a highly abrasion resistant material having a low transverse rupture strength, such as a composite carbide which includes tungsten carbide, and sleeve 14 is constructed of a hardened alloy steel that is not very abrasion resistant and possesses a relatively low transverse rupture strength. In fact, sleeve 14 is constructed of steel alloy that is easily machinable thereby permitting removal of worn button 12 from bore 16 and replacement thereof with an unused button assembly 10. In comparison the tungsten carbide material is not machinable and must be ground. Thus, during a conventional cutting operation, sleeve 14 will be eroded by contact with a subterranean strata at a significantly faster rate than button 12 thereby permitting a relatively large portion of the button which is exposed to contact with the subterranean strata to be unsupported. Under conventional load pressures encountered during drilling, e.g., 20,000 psi to 40,000 psi, the exposed, unsupported portion of tungsten carbide 12 is highly subject to transverse shearing, fracturing and rupturing as indicated by the dotted lines in FIG. 1*b*. Such shearing, fracturing or rupturing greatly reduces the cutting life of conventional button assemblies and increases cutting costs. And although these prior art button assemblies are designed as being replaceable, if one button is replaced, every other button must be replaced to provide for a uniform cutting surface. Thus, it is more economical in conventional practice to utilize an unused rotary rock cutter than to replace all the button assemblies of a worn rotary rock cutter.

Figure 2A:
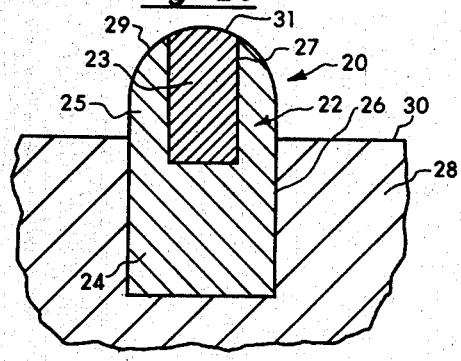
FIG. 2*a* is a cross sectional view of the button assembly of the present invention as secured to a rotary rock cutter.
Figure 2B:
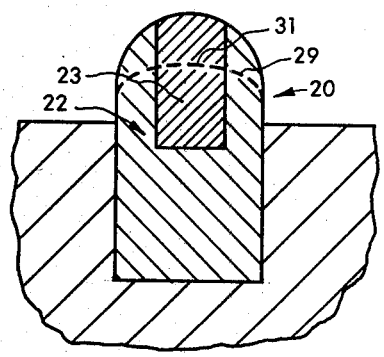
FIG. 2*b* is a cross sectional view of the button assembly of the present invention secured to a rotary rock cutter, depicting wear caused by penetration of subterranean strata.

The button assemblies of the present invention are illustrated generally as 20 in FIG. 2. Button assemblies 20 are fixedly secured within bore 26 of rotary rock cutter matrix 28, preferably by press fitting. Button assemblies 20 are formed of a button 22 having a carbide insert 23 positioned within the cutting end thereof. Insert 23 is preferably constructed of a tungsten carbide composite, and therefore, is highly abrasion resistant but has a low transverse rupture strength. Button 22 is constructed of a material which has a high abrasion resistance, has a significantly higher transverse rupture strength than insert 23 and is not machinable but may be ground. Button 22 may be constructed, for example, of a heat treated high alloy steel (such as 4330 material) having a high silicon content, such as the alloy manufactured under the trade name 300-M by the International Nickel Company or it may be constructed of a high alloy steel containing a high chrome content (Type D-7 tool steel). The content alloy has a somewhat lower sheer strength than the silicon content alloy. Since button 22 may not be machined, it is designed to be non-replaceable in the matrix. Button 22 has a lower portion 24 which is preferably cylindrically configured and is substantially solid. An upper portion 25 is integral with lower portion 24 and has a dome-shaped leading end 29 which serves as a cutting surface and projects outwardly from the exterior matrix surface 30. An axial bore 27 is formed in the dome-shaped end 29 of upper portion 25 and extends into upper portion 25 and lower portion 24. The alloy ignot for the button is melted and the fluid material is force injected into a multi-cavity mold and is allowed to cool. The pieces are removed from the mold leaving a ceramic coating on parts of the material which are removed by shot blasting. The material is then annealed at which time the bore is drilled. Once axial bore 27 is formed, button 22 is heat treated to increase the hardness thereof to above 50 Rockwell C hardness (RC), preferably to about 54 or 55 RC. The button becomes too brittle if made beyond 55 RC, below 47 RC the button is too soft. In this manner, the configuration of bore 27 remains undamaged. Button 22 is through hardened, i.e., is capable of being and is hardened uniformly throughout, even throughout heavy sections. Tungsten carbide insert 23, which is preferably cylindrical, is fixedly secured within axial bore 27, preferably by press fitting. Tungsten carbide insert 23 may have correspondingly configured dome-shaped outer end 31 so as to provide a smooth transition between outer end 29 of upper portion 25. The length of the carbide insert is at least equal to the diameter thereof, and the cross sectional area of the surrounding button 22 is at least as great as the cross sectional area of the insert supported thereby. The insert 23 may penetrate to a level in the button 22 which is just above surface 30, equal to it, or slightly below it.

The button assembly may project outwardly from matrix surface 30 in the preferred embodiments up to 1.5 inches when utilized in a hard rock rotary cutter and up to 3 inches when utilized in a rotary disc cutter. Such projection length represents a substantial increase over prior art projections set forth in FIG. 1 which are typically $\frac{1}{4}''$ to $\frac{1}{2}''$. This increased projection is permitted since button 22 supports insert 23 throughout subterranean drilling as hereinafter set forth. Not only does such increase represent an increase in the useful life of the rotary rock cutter, but also matrix washing is effectively minimized since the matrix is further removed from the cutting surface of the rotary rock cutter.

As thus assembled, the button assemblies 20 of the present invention provide a greatly improved abrasion resistant cutting surface for rotary rock cutters. Since button 22 has a higher abrasion resistance than conventionally utilized materials, the exposed cutting surface of button assembly 20 will erode during drilling in a relatively uniform manner as illustrated by the dotted line in FIG. 2*b*. Due to this relatively uniform erosion and the high transverse rupture strength of button 22, upper portion 25 of button 22 will provide transverse longitudinal support for tungsten carbide insert 23 throughout the entire period of time in which drilling operations proceed.

The erosion of the button assembly 20 is believed to occur as follows. The insert 23 and the button 22 penetrate the strata and commence to wear. The insert, however, due to its greater abrasion characteristics, wears slower and becomes more exposed than the button. The insert then wears down faster than the button since it is more exposed to the strata than the button. This cycle repeats itself with the insert and the button cooperating in the penetration of the strata. During such penetration, the button having a higher transfer rupture than tungsten carbide supports the insert from rupture.

Also, the leading end 29 of upper portion 25 serves as a cutting surface which penetrates subterranean strata contacted during drilling. Thus, as upper portion 25 of button 22 functions to support and prevent transverse rupturing of tungsten carbide insert 23 and penetrate subterranean strata, a much smaller diameter carbide insert may be utilized than in conventional rotary rock cutters to do the same job. Further, although axial bore 27, and therefore, insert 23 may extend a substantial distance into lower portion 24 of button 22, it is preferred to extend bore 27 and insert 23 only a relatively short distance into lower portion 24. Such positioning may be accomplished in the button assemblies of the present invention because upper portion 25 provides support for insert 23 throughout the entire cutting life of the insert. As tungsten carbide is a relatively expensive material in the construction of inserts for rotary rock cutters, such reduced dimensions result in substantial material, and therefore, cost savings.

The amount of tungsten carbide utilized in the button assembly 20 of the present invention is significantly less than the amount of tungsten carbide in the prior art approaches. For example, in a typical case, assuming the above dimensions, the weight of tungsten carbide in button assembly 20 is about 40 grams whereas the weight of tungsten carbide in prior art button assembly 10 of FIG. 1 is about 600 grams. This results in at least a 90% reduction. At current prices, the 300-M material is less than 50% of the price of tungsten carbide and the resulting cost in manufacturing the button assembly 20 of the present invention can be less than 25% of the cost in manufacturing the prior art approach. In a typical application over 100 button assemblies can be utilized in a single cutter, hence the cost savings of the button of the present invention represent almost two orders of magnitude in cost savings.

Not only are the button assemblies 20 of significantly lower cost in manufacturing, but due to capability to protrude or extend so far above the matrix (3 to 6 times further than modern day prior art approaches), the button assemblies 20 of the present invention wear two to four times longer on the rotary cutter than prior approaches.

It has also been discovered that due to the decreased amount of erosion of the button assemblies 20 of the present invention encountered during penetration of subterranean strata, increased load pressures per button may be utilized, e.g., twice the load pressure. These increased load pressures per button result in faster penetration of subterranean strata since a large load pressure on an individual button tends to fracture a relatively large area of subterranean strata instead of crushing a much smaller area per revolution. This increased load pressure per button also translates into greater peripheral spacing between buttons along the surface 30 of rotary rock cutter matrix 28, thus resulting in even further increased cost savings.

Hence, with significantly lower manufacturing costs, with significantly longer wear capabilities, and with fewer button in a given area of the cutter, the present invention represents a several order of magnitude reduction in cost. Yet, the button of the present invention is capable of encountering greater loads.

Figure 3:
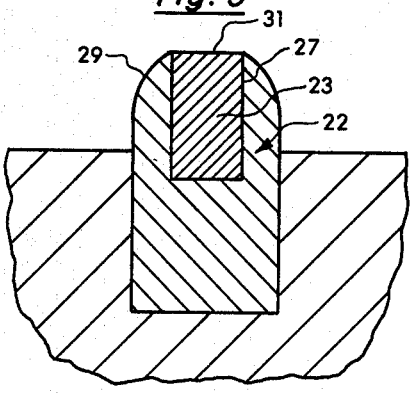
FIG. 3 is a cross sectional view of an alternative embodiment of the button assembly of the present invention as secured to a rotary rock cutter.

As illustrated in FIG. 3 the cutting surface 31 of tungsten carbide insert 23 does not have to conform to the shape of the outer surface 29 of button 22 and may be even recessed a relatively short distance within axial bore 27. Once drilling operations proceed, leading surface 29 will eventually abrade to provide a uniform cutting surface with tungsten carbide insert 23.

Figure 4:
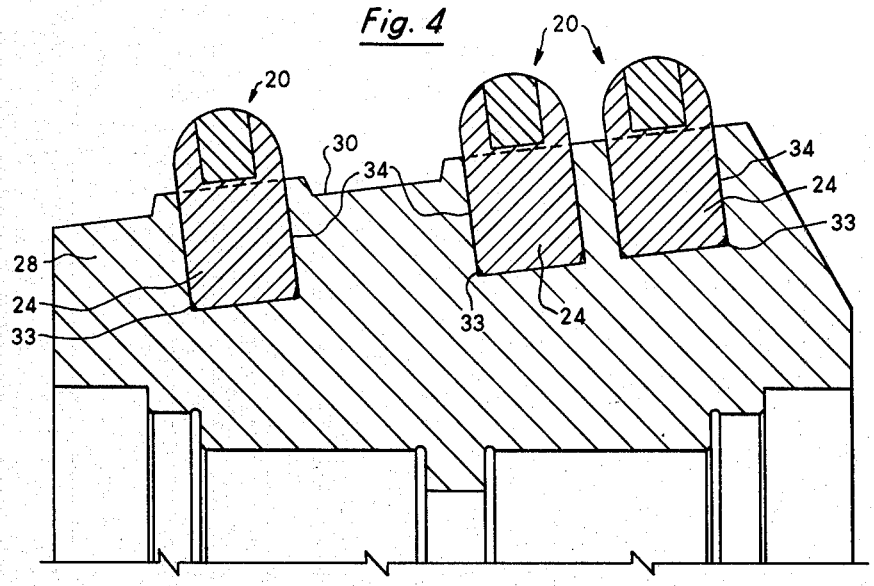
FIG. 4 is a cross sectional view of the button assemblies of the present invention as secured to a hard rock rotary cutter taken along a plane parallel to the axis of the cutter.

Turning now to FIG. 4, the button assemblies of the present invention are illustrated as assembled in a hard rock rotary cutter, i.e., three-cone rotary cutters or large diameter big hole cutters employed under load pressures of about 15,000 psi to about 50,000 psi. A hard rock rotary cutter has a matrix 28 which has an external surface 30. Button assemblies 20 are fixedly secured preferably by press fitting within correspondingly configured bores 34 which extend from surface 30 into matrix 28. The lower portion 24 of button assembly 20 is provided with a chamfered edge 33 to aid in positioning lower portion 24 of button assembly 20 within bore 34 during press fitting thereof. Button assemblies 20 may be positioned in rows or may be randomly positioned along surface 30.

Button assemblies 20 are preferably dimensioned such that the button thereof is of a length of about 0.8 to about 3.75 inches and a diameter of 0.4 to 1.25 inches. The tungsten carbide insert of button assemblies 20 is of a shorter length than the button and a diameter of about 0.3 to about 0.75 inches. Preferably, the insert projects about 0.08 to about 0.25 inches beyond the leading edge of the button and the button assemblies project about 0.05 inches to about 1.5 inches above the external matrix surface 30.

Figure 5:
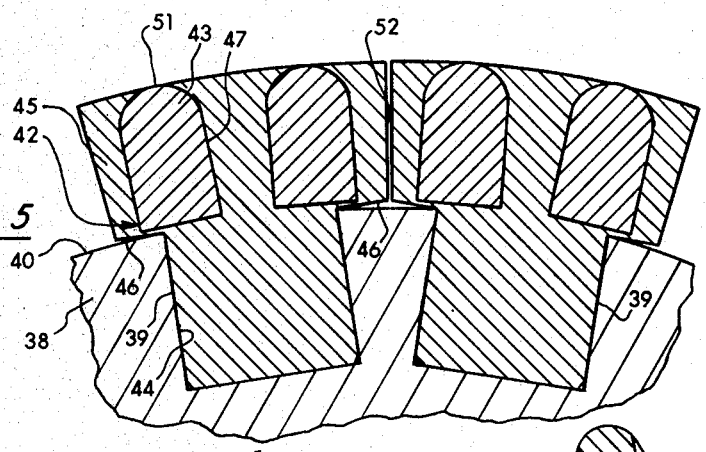
FIG. 5 is a cross sectional view of an alternative embodiment of the button assemblies of the present invention as secured to a rotary disc cutter taken along a plane perpendicular to the axis of the cutter.

As illustrated in FIG. 5, the button assemblies of the present invention may be utilized as the cutting surface in a rotary disc cutter.

Conventional rotary disc cutters are formed from a wedge-shaped steel ring which is heat treated. This heat treated steel ring cannot be through hardened but is hardened such that an inner core thereof is relatively soft while the exterior is hardened. Such disc cutters are conventionally used at load pressures up to about 55,000 psi or greater if the strata is fractured. If the steel in the ring is too soft, the ring cannot withstand the impact loads to which it is subjected. If the steel in the ring is too hard throughout, such as 300-M, the load will break it. Furthermore, if the ring in a conventional disc cutter is made from 300-M, it is too brittle to be effective.

Because of the transverse rupture problem associated with solid tungsten carbide buttons, the use of tungsten carbide in rotary disc cutters (where transverse forces are high) has been impractical. However, the button assembly of the present invention is capable of being used in rotary disc cutter applications.

The rotary disc cutter of the present invention shown in FIG. 5, has a matrix 38 which has an exterior surface 40 and a plurality of circumferentially aligned, space-apart bores 39 therein. Bores 39 extend from surface 40 radially inward a predetermined distance. Button assemblies 42 have a shank 44 which possesses a cross sectional configuration substantially identical to that of bores 39 in matrix 38. The upper portion 45 of button assemblies 42 is integrally formed with shank 44 and, as illustrated in FIG. 5, defines shoulders 46 at the junction therewith. Thus as shank 44 is fixedly secured, preferably by press fitting, into bores 39 in matrix 38, shoulders 46 of upper portion 45 will abut surface 40 of matrix 38 and shank 44 will abut the base of bore 39. Shank 44 may be provided with a chamfered edge to aid in positioning within bores 39. Bores 39 in matrix 38 are spaced and upper portions 45 dimensioned such that when button assemblies 42 are fixedly secured in bores 39, ends 52 of upper portions 45 of adjacent button assemblies 42 will be in juxtaposed relationship thereby preventing any relative rotation between aligned button assemblies 42. Tungsten carbide inserts 43 are fixedly secured within bores 47 in upper portion 45, preferably by press fitting. Preferably, bores 47 extend as close as practical to shank 44. Although a plurality of tungsten carbide inserts 43 are illustrated as being fixedly secured within upper portion 45 of an individual button assembly 42, it will be understood that one tungsten carbide insert may be fixedly secured to each individual button assembly 42. As illustrated in FIG. 5, a leading end 51 of tungsten carbide insert 43 may project beyond the uppermost surface of upper portion 45 thereby defining a leading cutting edge.

As assembled in a rotary disc cutter, button assemblies 42 are preferably dimensioned such that the button thereof is of a length of about 1 to about 4.5 inches and has a diameter of about 1 to 1.5 inches. Insert 43 of a shorter length than the button and is of a diameter of about 0.3 to about 0.75 inches. Preferably, insert 43 projects about 0.08 to 0.25 inches beyond the leading edge of the button and the button assemblies project about 1 to about 3 inches above the exterior matrix surface 40.

Figure 6:
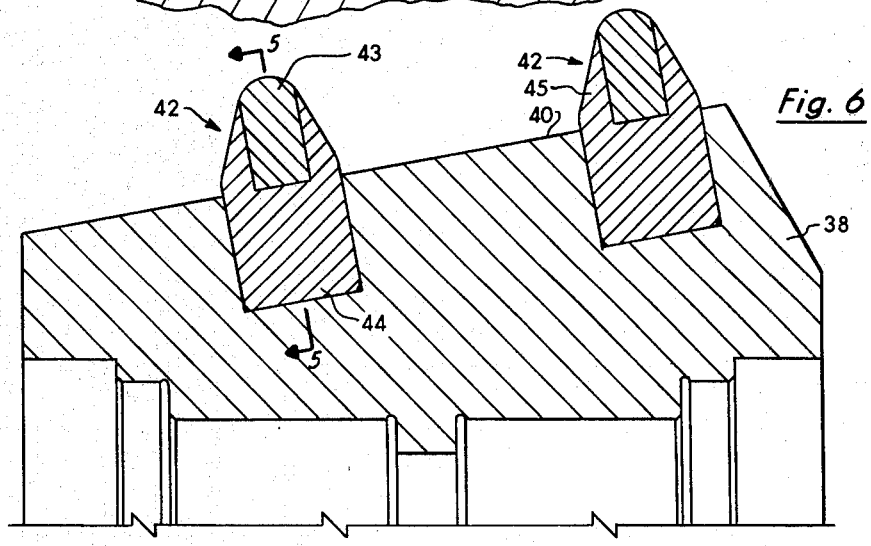
FIG. 6 is another cross sectional view of the button assemblies depicted in FIG. 5 as secured to a rotary disc cutter as taken along line 6—6 of FIG. 5.

As illustrated in FIG. 6, the button assemblies of the present invention when assembled in a rotary disc cutter provide a cross sectional wedge shaped cutting surface, which is rotated against the strata to be cut. It will be appreciated from a collective view of FIGS. 5 and 6, that upper portion 45 supports insert 43 about substantially the entire periphery thereof and along substantially the entire length thereof, as previously described with respect to FIG. 2*a* and *b*. Utilizing the button assemblies of the present invention as the cutting surface in a rotary disc cutter serves to eliminate the deficiencies of the prior art annular cutting ring, as well as to extend the useful cutting life of the disc cutter and to reduce the cost of manufacture, as more fully described herein.

Thus, the button assembly of the present invention has a greatly increased cutting life over conventional button assemblies, from two-four times, can be manufactured at a greatly reduced cost (about half the cost of conventional assemblies due to the decreased amount of carbide utilized), can be employed in fewer numbers and may be spaced apart of greater distances on rotary rock cutters, can achieve faster penetration of rock strata due to increased load pressures per button, and can protrude at greater distances from the cutter matrix thereby increasing the useful cutting life thereof while effectively minimizing matrix washing.

Figure 7:
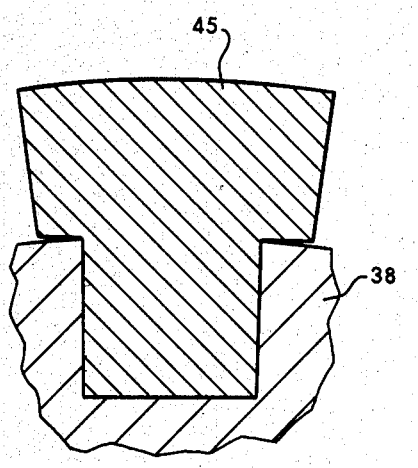
FIG. 7 is a cross sectional view of an alternative embodiment of FIG. 5 wherein the insert is not utilized.
Figure 8:
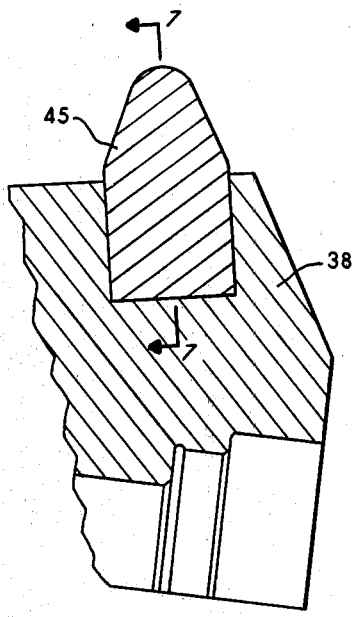
FIG. 8 is a cross sectional view of the embodiment of FIG. 7 taken along line 707.

FIGS. 7 and 8 show an alternative embodiment of the rotary cutter of FIGS. 5 and 6 to use only the button 45 without the tungsten insert 43. This embodiment is also a significant improvement over the prior art disc cutters.

Figure 9:
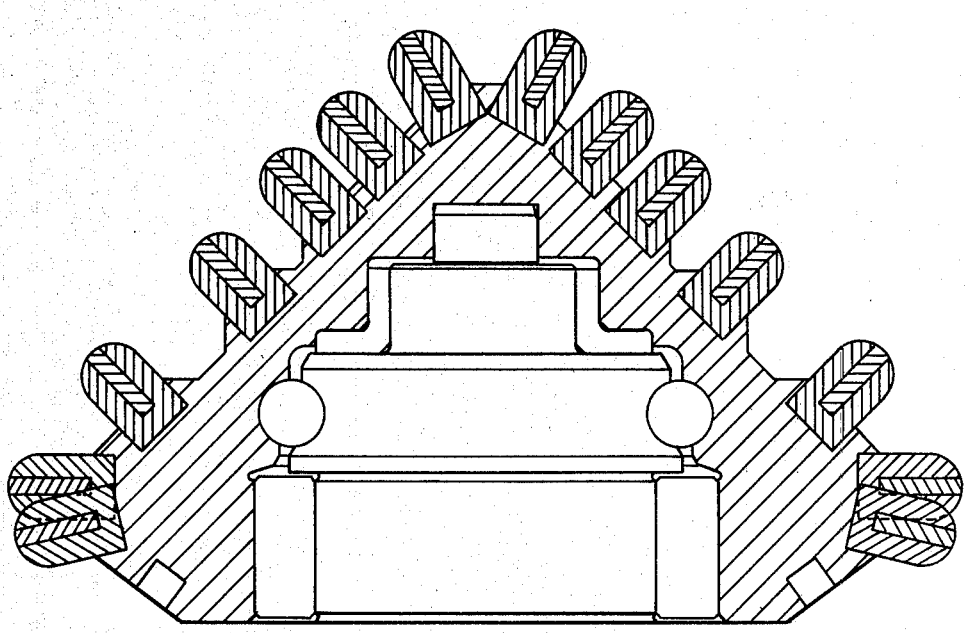
FIG. 9 is a cross sectional view of a three-cone cutter using the button-assemblies of the present invention.

FIG. 9 illustrates the use of the button assemblies 20 of the present invention in one cone of a three-cone cutter.

While various embodiments and modifications of this invention have been described in the foregoing description, further modification will be apparent to those skilled in the art. Such modifications are included within the scope of this invention as defined by the following claims.

I claim:

1. A non-replaceable and non-percussion button assembly fixedly secured into the matrix of a cutting tool, said cutting tool being capable of penetrating subterranean strata at load pressures up to 55,000 psi, said button assembly comprising:

a cylindrically shaped button press-fittingly inserted into a formed bore within said matrix, fully engaging the sides and bottom of said formed bore, and extending above the surface of said matrix, said press-fitting insertion being sufficient to hold said button in said matrix under said load pressures, said button being molded from a non-machinable steel material having (1) a substantial hardness between 50 to 55 RC, (2) a transverse rupture strength greater than the transverse rupture strength of tungsten carbide, and (3) an abrasion resistance less than the abrasion resistance of tungsten carbide, the aforesaid steel material being capable of being ground, a cylindrically molded tungsten carbide insert being press-fittingly inserted into a centrally formed cylindrical bore within said button, and to fully engage the sides and bottom of the aforesaid bore, the aforesaid press-fitting insertion being sufficient to hold said insert in said button under said load pressures, the sides of said insert being parallel to the sides of said button and the cross-sectional area of said button being at least equal to the cross-sectional area of said insert, the length of said insert being at least equal to the diameter of said insert and less than the length of said button, substantially the entire length of said insert in the aforesaid formed bore extending above the surface of said matrix, and said button being capable of cutting said strata at load pressures up to 55,000 psi when said insert wears down toward said button and being capable of providing transverse longitudinal support to said insert as said button and insert wear down wherein said button and said insert wear down from cutting said rock at a substantially equal rate.

* * * * *